United States Patent [19]

Juillet et al.

[11] 4,454,958

[45] Jun. 19, 1984

[54] INVIOLABLE COVER FOR A VESSEL APERTURE

[75] Inventors: Jacques Juillet, Choisy le Roi; Eugenio Olmi, Longueville; Michel Stephan, Versailles, all of France

[73] Assignee: Le Moulage Automatique, Clamart, France

[21] Appl. No.: 404,447

[22] Filed: Aug. 2, 1982

[30] Foreign Application Priority Data

Aug. 11, 1981 [FR] France ..... 81 15503

[51] Int. Cl.³ ..... B65D 43/14; B65D 51/04

[52] U.S. Cl. ..... 220/339; 206/380; 206/382

[58] Field of Search ..... 220/339; 16/225; 206/380, 382; 150/0.5

[56] References Cited

U.S. PATENT DOCUMENTS 3,933,296 1/1976 Ruskin et al. ..... 220/339

4,243,140 1/1981 Thrun ..... 220/339

*Primary Examiner*—George T. Hall

*Attorney, Agent, or Firm*—Rodgers & Rodgers

[57] ABSTRACT

Cover for a vessel aperture manufactured in one piece notably through the casting of a plastic material, comprising in part a channeled frame adapted to be sealed or otherwise attached to the outer edges of a vessel aperture, a cover adapted to fit into the frame in closed position, the frame and cover being connected by a zone of liaison constituting a hinge and formed in a single piece interdependent with the frame and cover from the time they were cast with the cover piece in the open position.

5 Claims, 5 Drawing Figures

INVIOLABLE COVER FOR A VESSEL APERTURE

The present invention involves an inviolable cover for vessel containers used in the treatment of pulverized materials. More specifically, the device concerns a cover manufactured in a single piece, primarily of a plastic material, including a channeled frame designed to be fitted into and sealed onto the edges of a vessel aperture, as well as the actual cover, and connected by a zone of liaison hinged to the frame piece and adapted to flange this frame by forcibly engaging into the fluting of the channeled frame, thereby inviolably sealing the vessel opening through which the contents may be extracted.

Numerous types of covers for vessel containers are actually known in the packaging field. Most of these covers are fashioned from two pieces connected by a detachable hinging device or separated one from the other, one of the pieces constituting a fixed frame over the vessel opening and the other being a cover designed to fit into this fixed frame. These two piece mechanisms do not offer, however, the guarantees necessary to assure the inviolability of the vessel container content in the sense that each cover is held in closed position simply by virtue of the more or less tight fit at the interior of the frame.

Consequently, the present invention has been developed for the purpose of assuring the inviolability of the vessel aperture such that the cover is fixed and interdependent with one side of the frame by means of the abovementioned intermediate zone of liaison constituting a full link or double hinge between this cover and frame and fixed and interdependent with at least one of the other sides of the frame by means of interdependent bolting pins or tenons which correspond to the frame and it into holes along the outer rim of the overlapping cover.

In one particular version of the inviolable cover and fashioned in a single flat piece, the frame is in the form of a concave basin hollowed at the bottom and being in conformity with the contour of the vessel opening. This frame allows for a part of the edge, in inverse U shape, to fit into the overlap against the edges of the opening and to seal thereto, as well as allows for a connection zone intimately united with the exterior flange on one side of the frame and bounded by two parallel fold lines separated from one another by a width corresponding to the distance somewhat less than the height of the outer flange. The zone of liaison being laterally extended from the side facing the frame by the cover which is able to be fitted into the interior of the concavity of the frame. The cover is designed in the form of a convex basin whose outer edges, including those borders uniting with the above mentioned zone of liaison, are curved slightly inward in order to press against the top of the outline of the frame when the cover is pressed down in a closed position into the frame and are bolted into position by the engagement of several pins projecting from the top of the frame into the outer borders.

More specifically, the contour of the concave basin of the frame and that of the convex basin of the cover are consonant in a way such that the cover may be engaged into the upper part of the concave basin of the frame through a tight and closely adjusted fit. The upper portion of the concave basin of the frame is designed with a greater depth than that of the cover basin in order to bring about in the closed position a certain distance between the full bottom of the cover basin and the hollowed bottom of the frame basin which has a slightly conical surface converging in its lower portion.

In another version of the inviolable cover, the hollowed bottom of the concave basin of the frame is designed to bear a measuring scoop, positioned diagonally in the chamber and attached by several suspension points to the walls of the chamber. The entire bottom of the actual cover basin is designed to establish a housing corresponding largely in shape to the measuring implement when the cover is set in closed position and fitted into the frame.

Other characteristics of the present invention will appear from the following description of the several adaptations of the inviolable cover, presented as nonrestrictive examples and represented in the accompanying drawings in which.

Figure 1:
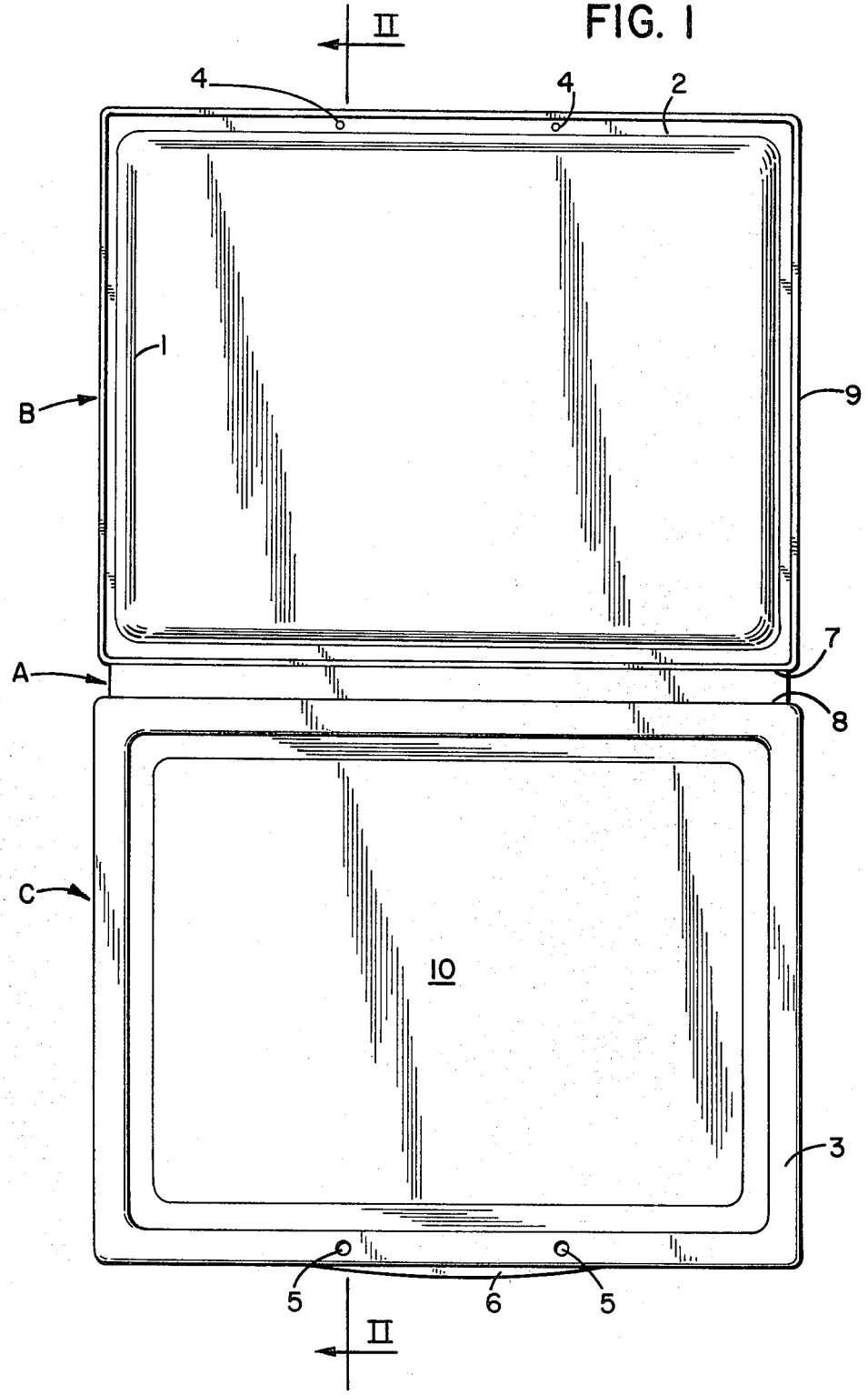
FIG. 1 is a plan view of the cover in open position according to one version of the invention.
Figure 2:
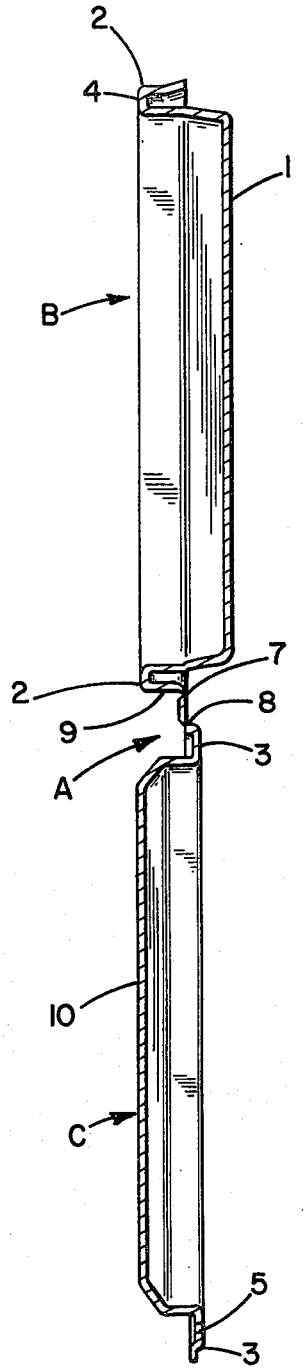
FIG. 2 is a sectional view of the cover shown in FIG. 1 taken along the line II—II in FIG. 1.
Figure 3:
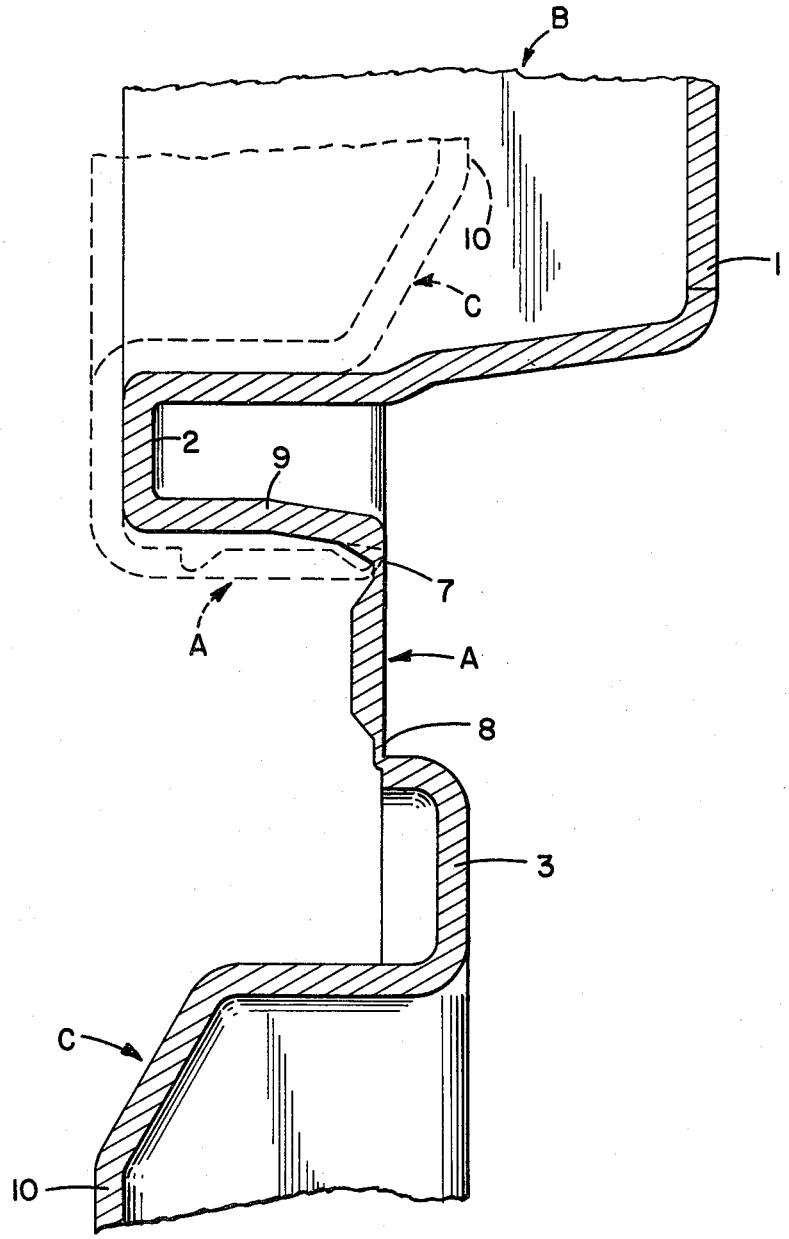
FIG. 3 is an enlarged sectional view of the zone of liason, represented by the solid line in the open position and by the dashed line in the closed position.

As depicted in FIGS. 1 through 3, the cover according to this invention is manufactured flat in a single element from a casted or injected plastic material and includes the frame B, adapted to be sealed onto a vessel aperture (not depicted), the actual cover C, and the zone of liaison A forming a hinge between parts B and C. As best seen in FIG. 2, the frame B is formed of a concave basin 1 whose base is hollowed and whose upper outer edges 2 are fashioned in an inverse U shape in order to fasten onto the edges of a vessel aperture and to seal it thereto. The cover piece C is also in the form of a full bottomed basin, but following a convex configuration, thereby enabling it to be housed in the frame B when the cover is in closed position. The edge plates 3 of the basin C are adapted and designed to press against the edge plates 2 of the frame piece B and lock together when the cover is in a closed position by means of the intermediate engagement of pins into the holes 5 along the edge plate 3 which has an exterior digital indicator located close to these holes.

As noted in particular detail in FIG. 3, the zone of liaison A between the frame B and the cover C is bounded by two thin folding lines 7, 8 parallel to each other and separated by a width less than the height of the exterior flange 9 of the sealing edge plate 2 for the frame B at the vessel aperture. Due to folding lines 7, 8, the zone of liaison A can be considered a double hinge allowing the cover C to be interdependent with the frame B at all times and to be pressed down and fitted into frame B in closed position with bottom 10 situated at a predetermined interval from the hollowed base 1 of the frame.

Figure 5:
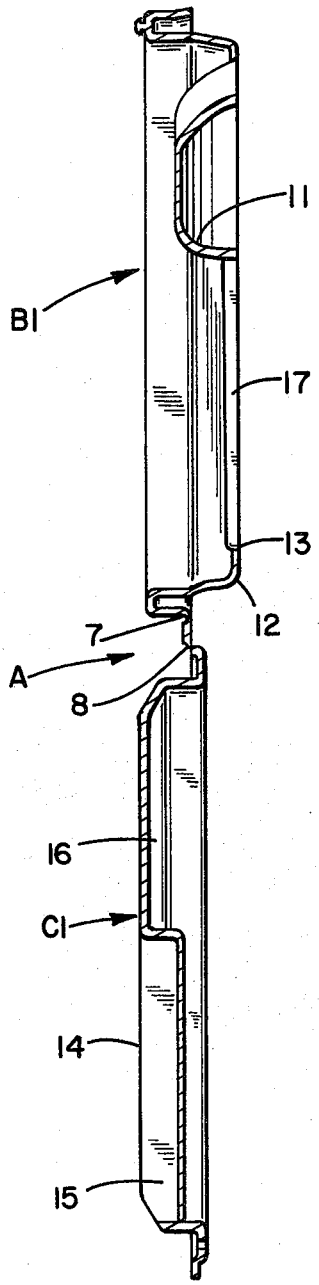
FIG. 5 is a sectional view of the cover shown in FIG. 4 taken along line V—V in FIG. 4.
Figure 4:
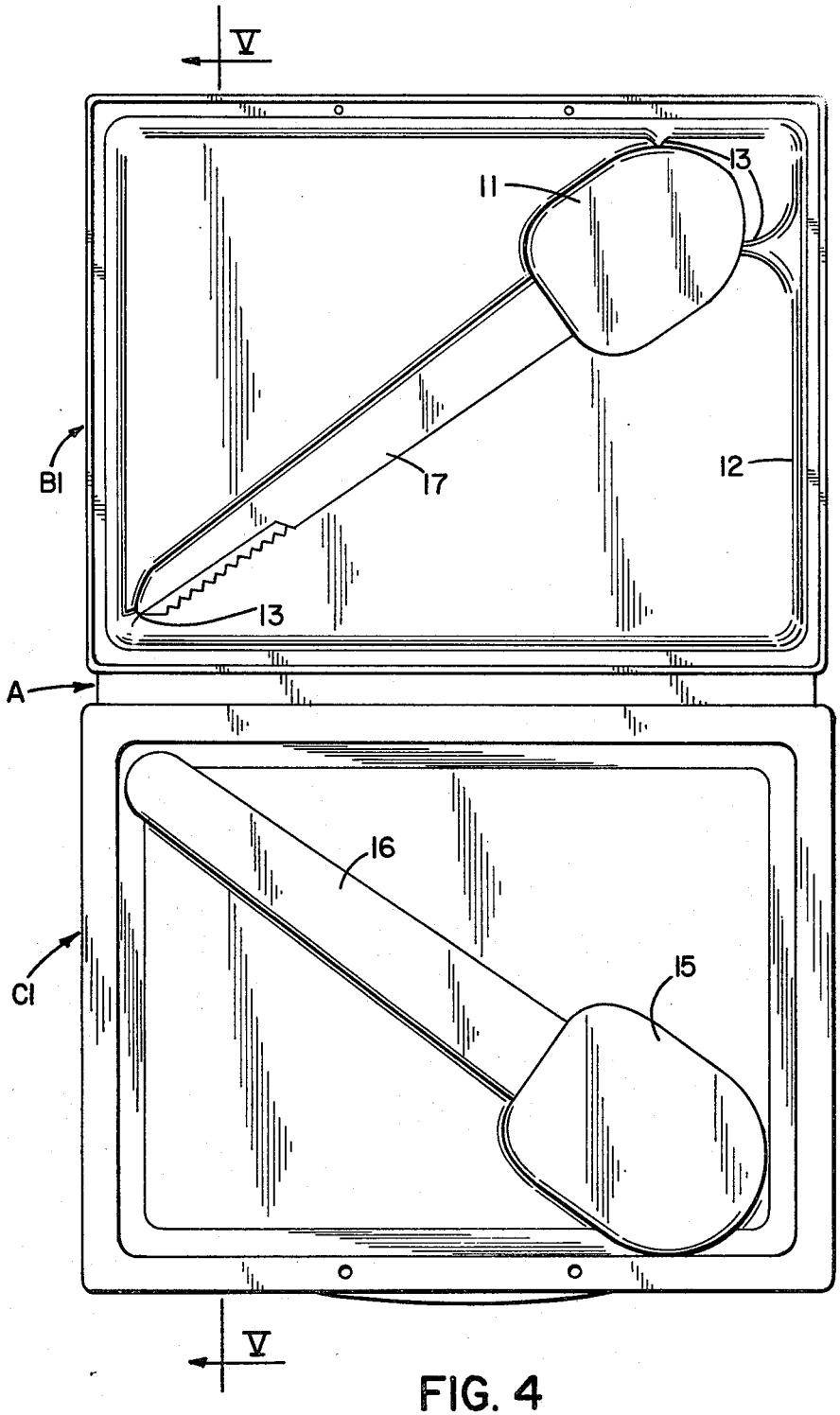
FIG. 4 is a plan view of a cover similar to that depicted in FIG. 1.

As represented in FIGS. 4 and 5, according to a second version of this invention, the cover, including the frame B1, the actual cover C1, and a zone of liaison A, forming a hinge between these two parts, includes measuring scoop 11. Scoop 11 is positioned diagonally in chamber 12 of the concave basin of the frame B1, wherein it is attached by several suspension points 13 which are disengagable at the moment of utilization. In this case, the entire floor 14 of the basin of the cover C1 is shaped to arrange housings 15 and 16 corresponding respectively to scoop 11 and to its handle 17, the zone of liaision A remaining identical to that of the cover in FIG. 1. The handle of the scoop forms a thin cutting element for the contents of the vessel container.

We claim:

1. A cover for a vessel aperture comprising a frame adapted to be sealed or otherwise affixed to the edge of said vessel aperture, a cover adapted to fit into said frame in closed position, and characterized in that said frame and said cover are connected by a zone of liaison, said zone of liaison comprising a double hinge formed from a single element interdependent with said frame and said cover, said frame is in the form of a concave hollow basin, said cover is in the form of a convex basin, the contours of said concave basin and said convex basin are shaped so that said convex basin can be fitted by means of a tight and close adjustment into the upper part of said concave basin, and said concave basin has greater depth than that of said convex basin in order to create in the closed position a space between the floor of said cover basin and the hollowed floor of said frame basin.

2. A cover according to claim 1 and further characterized in that said hollowed floor is designed to house a measuring scoop by means of multiple suspension points attached to the walls thereof.

3. A cover for a vessel aperture comprising a frame adapted to be sealed or otherwise affixed to the edge of said vessel aperture, a cover adapted to fit into said frame in closed position, and characterized in that said frame and said cover are connected by a zone of liaison, said zone of liaison comprising a double hinge formed from a single element interdependent with said frame and said cover, said frame has an exterior flange disposed around the edge thereof, said zone of liaison between said frame and said cover is bounded by two parallel folding lines separated from each other by a width equal to less than the height of said exterior flange, said frame is in the form of a concave hollow basin, said cover is in the form of a convex basin, the contours of said concave basin and said convex basin are shaped so that said convex basin can be fitted by means of a tight and close adjustment into the upper part of said concave basin, and said concave basin has greater depth than that of said convex basin in order to create in the closed position a space between the floor of said cover basin and the hollowed floor of said frame basin.

4. A cover according to claim 3 and further characterized in that said hollowed floor is designed to house a measuring scoop by means of multiple suspension points attached to the walls thereof.

5. A cover for a vessel aperture comprising a frame adapted to be sealed or otherwise affixed to the edge of said vessel aperture, a cover adapted to fit into said frame in closed position, and characterized in that said frame and said cover are connected by a zone of liaison, said frame is in the form of a concave hollow basin, said cover is in the form of a convex basin, and the contours of said concave basin and said convex basin are shaped so that said convex basin can be fitted by means of a tight and close adjustment into the upper part of said concave basin.

* * * * *